US012098711B2

(12) United States Patent
Hillebrand et al.

(10) Patent No.: US 12,098,711 B2
(45) Date of Patent: Sep. 24, 2024

(54) COMPRESSOR DEVICE AND COMPRESSION METHOD

(71) Applicant: sera GmbH, Immenhausen (DE)

(72) Inventors: Stephan Hillebrand, Witzenhausen (DE); Patrick Zeisberg, Espenau (DE); Nils Friedrich, Willingshausen (DE)

(73) Assignee: SERA GMBH, Immenhausen (DE)

( * ) Notice: Subject to any disclaimer, the term of this patent is extended or adjusted under 35 U.S.C. 154(b) by 31 days.

(21) Appl. No.: 17/048,132

(22) PCT Filed: Apr. 18, 2019

(86) PCT No.: PCT/EP2019/060176
§ 371 (c)(1),
(2) Date: Oct. 16, 2020

(87) PCT Pub. No.: WO2019/202115
PCT Pub. Date: Oct. 24, 2019

(65) Prior Publication Data

US 2021/0164455 A1 Jun. 3, 2021

(30) Foreign Application Priority Data

Apr. 19, 2018 (DE) ..... 10 2018 109 443.4

(51) Int. Cl.
*F04B 9/111* (2006.01)
*F04B 1/124* (2020.01)
(Continued)

(52) U.S. Cl.
CPC ..... *F04B 1/124* (2013.01); *F04B 9/111* (2013.01); *F04B 9/1178* (2013.01); *F04B 53/14* (2013.01); *F04B 53/162* (2013.01)

(58) Field of Classification Search
CPC ..... F04B 9/117–1178; F04B 35/00; F04B 35/008; F04B 9/109–1095; F04B 37/00; F04B 37/10; F04B 37/18
See application file for complete search history.

(56) References Cited

U.S. PATENT DOCUMENTS 1,782,975 A 11/1930 Schaer
1,816,403 A 7/1931 Schaer
(Continued)

FOREIGN PATENT DOCUMENTS

CN 2809263 Y 8/2006
CN 103470467 A 12/2013
(Continued)

*Primary Examiner* — Thomas Fink
(74) *Attorney, Agent, or Firm* — McCoy Russell LLP

(57) ABSTRACT

A compressor device for compressing a gas in at least one compression chamber in at least one compression cylinder is disclosed. In each of at least two drive cylinders, at least one drive piston is disposed, said at least one drive piston dividing each of the at least two drive cylinders into two drive chambers. The at least one first and second drive chamber, by way of a hydraulic fluid, are able to be periodically impinged with a fluid pressure in order for the respective drive piston to be moved. Each of the remaining drive chambers in the at least two drive cylinders, by way of a connection piece, are connected in a non-positive locking manner by a fluid. The movement of the drive pistons by way of at least one mechanical connection means is able to be transmitted to at least one compression piston.

16 Claims, 11 Drawing Sheets

(51) Int. Cl.

| | |
|---|---|
| ***F04B 9/117*** | (2006.01) |
| ***F04B 53/14*** | (2006.01) |
| ***F04B 53/16*** | (2006.01) |

(56) References Cited

U.S. PATENT DOCUMENTS

| | | | | | |
|---|---|---|---|---|---|
| 2,296,647 | A | | 9/1942 | McCormick | |
| 2,799,444 | A | | 7/1957 | Schemmel | |
| 2,991,003 | A | | 7/1961 | Petersen | |
| 3,077,838 | A | | 2/1963 | Maglott | |
| 3,314,594 | A | | 4/1967 | Rietdijk | |
| 3,331,329 | A | | 7/1967 | Bauer | |
| 3,653,303 | A | * | 4/1972 | Zurcher | F04B 39/0005 92/162 R |
| 3,904,326 | A | * | 9/1975 | Clement | F04B 33/00 417/571 |
| 4,334,833 | A | | 6/1982 | Gozzi | |
| 4,368,008 | A | | 1/1983 | Budzich | |
| 4,382,750 | A | | 5/1983 | Robertson et al. | |
| 4,478,556 | A | | 10/1984 | Gozzi | |
| 4,515,516 | A | | 5/1985 | Perrine et al. | |
| 4,653,986 | A | | 3/1987 | Ashton | |
| 4,710,104 | A | * | 12/1987 | Dring | F04B 9/113 417/342 |
| 4,761,118 | A | | 8/1988 | Zanarini | |
| 4,920,862 | A | | 5/1990 | Muller | |
| 5,209,649 | A | | 5/1993 | Dose et al. | |
| 5,584,664 | A | | 12/1996 | Elliott et al. | |
| 5,782,612 | A | | 7/1998 | Margardt | |
| 5,863,186 | A | | 1/1999 | Green et al. | |
| 6,077,053 | A | | 6/2000 | Fujikawa et al. | |
| 2010/0172771 | A1 | * | 7/2010 | Hoffarth | F04B 5/02 417/393 |
| 2012/0096845 | A1 | * | 4/2012 | Ingersoll | F03D 9/28 60/408 |
| 2017/0184090 | A1 | | 6/2017 | Hetcher et al. | |
| 2018/0080413 | A1 | * | 3/2018 | Kounosu | F04B 49/06 |

FOREIGN PATENT DOCUMENTS

| | | | |
|---|---|---|---|
| CN | 204253325 | U | 4/2015 |
| DE | 487549 | C | 12/1929 |
| DE | 509293 | C | 10/1930 |
| DE | 944516 | C | 6/1956 |
| DE | 1123794 | B | 2/1962 |
| DE | 1453585 | A1 | 1/1969 |
| DE | 3814824 | A1 | 11/1989 |
| DE | 4328264 | A1 | 3/1995 |
| EP | 0064177 | A1 | 11/1982 |
| EP | 0193498 | A2 | 9/1986 |
| GB | 1088098 | | 10/1967 |
| JP | S5337902 | A | 4/1978 |
| JP | H01113581 | A | 5/1989 |
| JP | H10288158 | A | 10/1998 |

* cited by examiner

COMPRESSOR DEVICE AND COMPRESSION METHOD

CROSS-REFERENCE TO RELATED APPLICATIONS

This application is the United States national phase of International Application No. PCT/EP2019/060176 filed Apr. 18, 2019, and claims priority to German Patent Application No. 10 2018 109 443.4 filed Apr. 19, 2018, the disclosures of which are hereby incorporated by reference in their entirety.

BACKGROUND OF THE INVENTION

Field of the Invention

The disclosure relates to a compressor device and to a compression.

Description of Related Art

Compressor devices of this type are considered for use in the processing industry, in mechanical engineering, or in the hydrogen sector, for example, where it is necessary for gas to be compressed for transportation, storage, processing, or use.

The gas to be compressed can be, for example, a non-corrosive gas free of solids, such as hydrogen, helium, carbon dioxide, argon, nitrogen, or ethylene. In principle, other gases or mixtures of gases may also be compressed.

Hydraulically driven piston compressors which are able to be driven by means of a drive cylinder are known from the prior art. Driving takes place by a movement of a drive piston which by way of a mechanical connection means such as, for example, a piston rod, is connected to a compression piston by way of which a volumetric variation of a compression chamber, and thus a compression of the gas, is periodically caused.

A hydraulically driven piston compressor can comprise, for example, a compression piston and a drive piston coupled to the compression piston (dual-piston principle). Coupling two compression pistons to one drive piston is likewise possible (triple-piston principle).

The use of a multiplicity of compression pistons can be utilized for compressing a larger volume of the gas per unit of time, or for increasing the compression of the gas. In order for the compression to be increased, the gas can initially be compressed in a first compression cylinder and then flow into a second and optionally a multiplicity of further compression cylinders and be further compressed. In principle, an arbitrary number of compression stages of this type are conceivable. For example, a triple piston compressor device having up to four compression stages is described in publication EP 0 064 177.

A general problem in the operation of a hydraulically driven piston compressor is a potential contamination of the gas, for example a sensitive gas such as hydrogen, by the hydraulic fluid, for example hydraulic oil, or a contamination by undesirable particles. The contamination can take place by propagation along the piston rod into the compression chamber, for example.

An arrangement of a triple-piston compressor device is described in the above-mentioned publication EP 0 064 177. A portion of the piston rod upon each adjustment of the drive piston switches over between the drive cylinder by way of the hydraulic fluid, and the compression cylinder by way of the gas, such that a contamination carryover is conceivable. In the case of the horizontal arrangement it is moreover problematic that seals on the piston rod which seal the compression cylinder and the drive cylinder, or seals on the compression pistons, can in particular wear on one side such that the risk of a contamination of the gas also exists in the case of this arrangement. The contamination by carryover oil is in particular very high in the case of a partially worn seal.

SUMMARY OF THE INVENTION

It is an object underlying the proposed solution to provide an improved compressor device in which the risk of the contamination of the gas is in particular minimized.

This object is achieved by a compressor device having features as described herein and by a compression method having features as described herein.

Accordingly, a compressor device for compressing a gas comprises at least one compression chamber in at least one compression cylinder. At least one drive piston is in each case disposed in at least two drive cylinders. The drive pistons divide in each case the at least two drive cylinders into two drive chambers. The at least one first or second drive chamber is able to be periodically impinged with a hydraulic fluid pressure in order for the respective drive piston to be moved.

A compressor device of this type can be formed, for example, by a piston compressor which is hydraulically driven by hydraulic oil and which is used for the compression of gases such as hydrogen or helium in the at least one compression cylinder. The at least one compression chamber can be formed, for example, by an in particular cylindrical cavity in the at least one compression cylinder. The gas can flow into the at least one compression cylinder by way of a valve-controlled gas inlet and flow out by way of a valve-controlled gas outlet, for example.

At least one drive piston is in each case disposed in the at least two drive cylinders, said drive pistons dividing in each case the at least two drive cylinders into two drive chambers.

For example, when the hydraulic fluid flows into the at least one first drive chamber, the first drive piston is moved in the drive cylinder and the at least one first drive chamber is enlarged. Since the first drive piston divides the first drive cylinder into two sub-chambers, the remaining drive chamber can correspondingly decrease in size.

The in each case remaining drive chambers in the at least two drive cylinders by way of a connection piece are connected to one another in a non-positive locking manner by a fluid. A non-positive locking connection of this type can also be understood to be a fluidic coupling. The in each case remaining drive chambers can be a third and a fourth drive chamber, for example.

The periodic impingement of the drive chambers with hydraulic fluid can lead to the drive pistons periodically moving in a mutually coupled manner by virtue of the fluidic coupling.

One drive chamber is enlarged in each of the drive cylinders when the respective other decreases in size, for example. The fluidic coupling can have the effect that the drive chamber which in each case decreases in size discharges the fluid to the respective other coupled drive chamber which is correspondingly enlarged.

The movement of the drive pistons can thus be synchronized. For example, the movement can take place in the sense of a differential cylinder in which the at least one first drive piston carries out a movement which is opposed to that of the at least one second drive piston. The at least one first drive piston, in the sense of a synchronized hydraulic cylinder, can likewise carry out a movement which is parallel to the at least one second drive piston. In principle, the operation of a synchronized hydraulic cylinder is more complex in comparison to the operation of a differential cylinder.

Undesirable leaks can arise between the at least one first and second drive chamber and the in each case remaining drive chambers. This arises in particular in the course of the operation from a high-pressure side to a low-pressure side. The leaks can lead to the movement of the drive pistons not being synchronized. In order for the fluid pressure between the at least one first and second drive chamber and the in each case remaining drive chambers to be synchronized, a synchronizing installation can be provided in one embodiment. The synchronizing installation can cause a correction in the movement of the drive pistons.

The synchronizing installation can be formed by a pressure compensation line, for example. The pressure compensation line can be disposed at one end of a drive chamber where a reversal of the movement of an assigned drive piston takes place. The drive piston may be able to be bypassed by the pressure compensation line. On account thereof, the fluid pressure between the two drive chambers of the respective drive cylinder may be able to be synchronized by means of the pressure compensation line. The pressure compensation line can furthermore have a check valve for controlling the pressure compensation, thus for opening or closing the pressure compensation line, for example. This principle can be considered to be a remedial or automatic correction of the stroke of the drive pistons.

The movement of the drive pistons by way of at least one mechanical connection means is able to be transmitted to at least one compression piston which is disposed so as to be movable in the at least one compression cylinder. The at least one compression piston in one embodiment delimits the at least one compression chamber in the at least one compression cylinder on one side such that movements of the drive pistons are able to be converted to a volumetric variation of the at least one compression chamber. At least one compression piston can be driven by way of at least two drive pistons. In particular, two drive pistons can in each case drive one compression piston.

The at least one compression cylinder in spatial terms is disposed so as to be separated from the at least two drive cylinders by a spacing. For example, the spacing can refer to a spacing between the at least one compression cylinder and the at least two drive cylinders along the direction of movement of the in each case at least one drive piston. In particular, the spacing can extend along the direction of gravity. The risk of any contamination of the gas to be compressed can thus be minimized.

In one exemplary embodiment, the at least one compression cylinder does not share any common wall with the at least two drive cylinders. A wall can be formed, for example, by a compression cylinder housing of the at least one compression cylinder or a drive cylinder housing of the at least two drive cylinders. A common wall can be present when the compression cylinder housing is contiguous to the drive cylinder housing. A common wall can in particular mean that the compression cylinder is in contact with one of the at least two drive cylinders. There can be a metallic contact, for example.

In one further exemplary embodiment, the spacing between the compression cylinders and the drive cylinders is at least the size of a maximum distance travelled by one of the in each case at least one drive pistons in the assigned drive cylinder. The spacing can in particular correspond to a stroke length of the at least one drive piston.

The spacing can thus be understood to be a distance between two positions of one of the in each case at least one drive pistons. The volume of an assigned drive chamber can be at a minimum in a first position of the drive piston. The hydraulic fluid can likewise change from flowing out of the drive chamber to flowing into the drive chamber. The volume of the drive chamber can be at a maximum in a second position of the drive piston. The hydraulic fluid can change from flowing into the drive chamber to flowing out of the drive chamber in the second position. The length can thus also be understood to be a maximum stroke or a maximum distance travelled by the drive piston in the drive cylinder.

In one further design embodiment, at least one connection chamber which, in particular for purging the at least one connection chamber, for detecting leaks in the at least one connection chamber, and/or for blocking the at least one connection chamber, is able to be filled with a functional gas is disposed between the at least one compression cylinder and the at least two drive cylinders.

For example, a first connection chamber can extend from the at least one first drive cylinder to the at least one compression cylinder. The second connection chamber can extend from the at least one second drive cylinder to the at least one compression cylinder. A common connection chamber can likewise extend from the at least one first drive cylinder and second drive cylinder to the at least one compression cylinder or a plurality of compression cylinders.

The at least one mechanical connection means can extend from the at least one first drive cylinder and/or the at least one second drive cylinder through the at least one connection chamber to the at least one compression cylinder. The at least one connection chamber can be surrounded by a connection housing, for example. The connection housing can delimit the at least one connection chamber in a gas-tight manner. Therefore, the at least one mechanical connection means can be protected in relation to external contamination such as undesirable gases and particles by the at least one connection chamber.

In one exemplary embodiment, the at least one connection chamber is filled with a functional gas. For example, the at least one connection chamber can be filled with a purging gas. Undesirable gases and particles can be removed from the at least one connection chamber by purging the connection chamber by means of the purging gas. It is likewise conceivable for the at least one connection chamber to be filled with a leakage gas. A leakage gas can serve for detecting leaks in the at least one connection chamber, for example. The at least one connection chamber can furthermore be filled with a seal gas. The gas can serve for blocking the at least one connection chamber in relation to gaseous media. For example, a seal gas can prevent the ingress of undesirable materials into the at least one connection chamber.

The at least one compression cylinder and the at least two drive cylinders can be mutually spaced apart by way of the at least one connection chamber. The at least one connection chamber herein can be at least as long as a maximum distance travelled by one of the in each case at least one drive pistons in the assigned drive cylinder. The spacing between the at least two drive cylinders and the at least one compression cylinder can thus be comprised by the at least one connection chamber. Accordingly, the at least one connection chamber can form a spacing chamber by way of which the at least two drive cylinders are spaced apart from the at least one compression cylinder. The at least one connection chamber can in particular be configured as a lantern such that oil-free sealing is enabled.

At least one measuring device by way of which for example a position of the in each case at least one drive piston in the assigned drive cylinder is able to be determined can also be disposed in at least one of the in each case two drive chambers. The determined position can serve for establishing at which point in time the at least one first and second drive chamber are to be impinged with a fluid pressure. A reversal of the movement of the in each case at least one drive piston may be able to be controlled on account thereof. The at least one measuring device can be formed by a position sensor, for example. The at least one measuring device can likewise be formed by a position measuring system which can be disposed on the at least one drive cylinder, for example.

It is conceivable for the at least one measuring device to be disposed in the at least one connection chamber so as to determine a position of the at least one mechanical connection means. A further example for a disposal of the at least one measuring device is on the at least one compression cylinder in order to determine a position of the at least one compression piston.

In one further exemplary embodiment the at least two drive cylinders are disposed below the at least one compression cylinder. Below herein can be understood as referring to gravity. The at least two drive cylinders along the direction of gravity are thus disposed so as to be lower than the at least one compression cylinder. On account thereof, hydraulic fluid leaking from a drive chamber, by virtue of gravity, cannot spread from the at least two drive cylinders in the direction of the at least one compression cylinder, for example.

Furthermore, a seal, in particular a labyrinth seal, can be provided between the at least one compression cylinder and the at least one compression piston and/or the at least one mechanical connection means.

It is also possible for a cooling device which discharges waste heat created in the operation of the at least one compression cylinder to be disposed on the at least one compression cylinder. The cooling device can be configured as an air-cooling or water-cooling system, for example.

It is also possible for the compressed gas for forming a compression in multiple stages to be able to be directed as gas to be further compressed from a first compression chamber into a second, third, or fourth compression chamber for compression. In principle, it is conceivable and possible for the gas to be further compressed to be able to be directed into an arbitrary number of further compression chambers for further compression.

A valve device for decoupling the movement of the drive pistons can be provided in one embodiment. For example, a hydraulic activation of the drive pistons can be decoupled by means of the valve device. The valve device herein may be able to be controlled as a function of data, items of information, and/or process parameters which are generated by means of the at least one measuring device, for example. In one exemplary embodiment the valve device is able to be controlled by a control system. The control system can control the impingement of the at least one first and second drive chamber with the hydraulic fluid by means of the valve device. The control system for controlling can resort to data, in particular data pertaining to positions or movements, from the at least one measuring device. In another embodiment, the control system for controlling can resort to process parameters such as, for example, the fluid pressure or the quantity of the conveyed hydraulic fluid (conveyed quantity).

The object is also achieved by a compression method having features as described herein.

BRIEF DESCRIPTION OF THE DRAWINGS

Exemplary embodiments will be illustrated in exemplary manner hereunder.

DETAILED DESCRIPTION OF THE INVENTION

Figure 1:
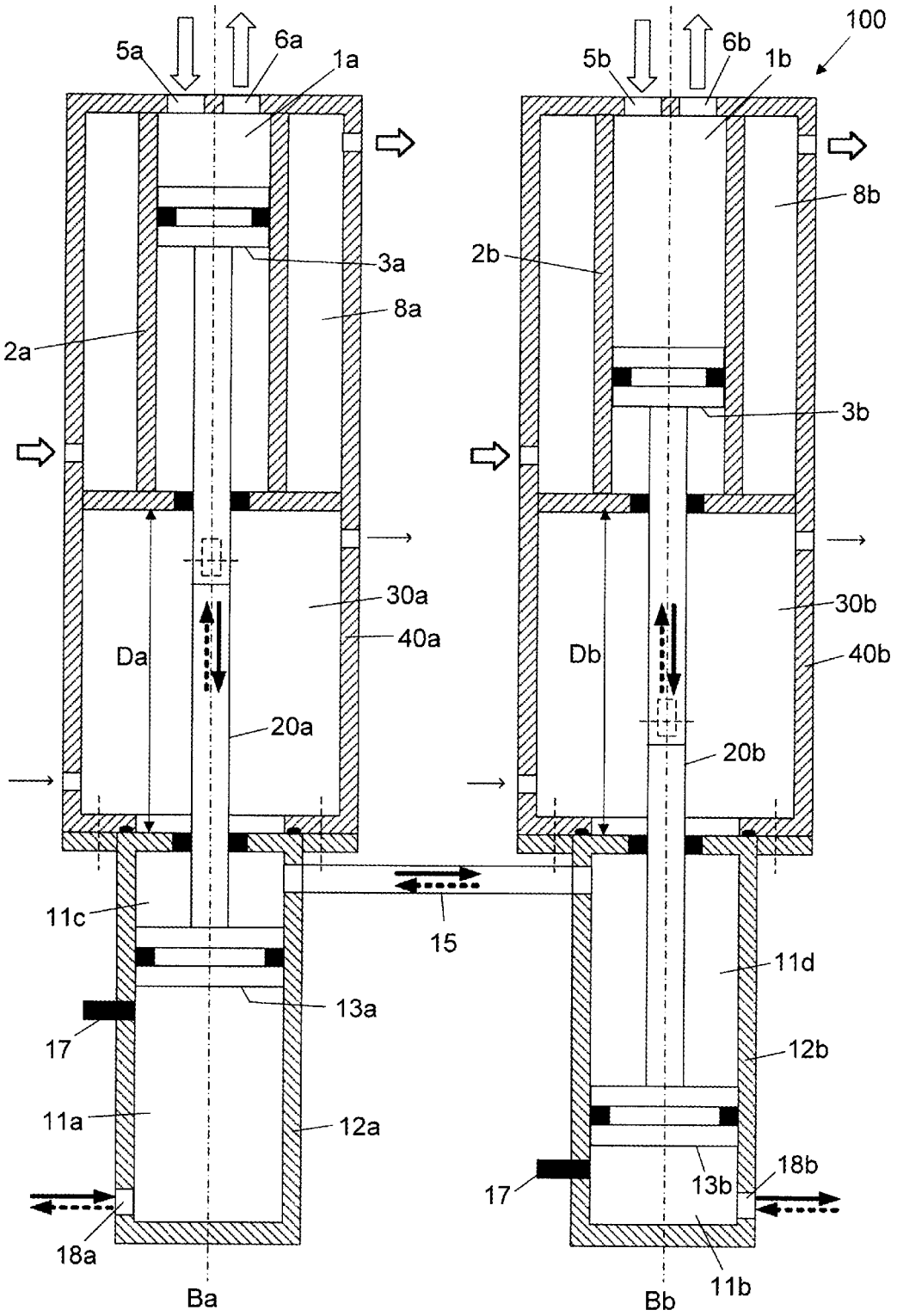
FIG. 1 shows a first embodiment of a compressor device (single-action, single-stage, water-cooled, rod-proximal hydraulic coupling of the drive chambers)

An embodiment of a compressor device 100 which has one compression chamber 1*a*, 1*b* in in each case one compression cylinder 2*a*, 2*b* for a gas is illustrated in FIG. 1.

The compression cylinders 2*a*, 2*b* here are disposed in a vertical manner so as to be mutually parallel, wherein the gas (to be compressed) entering from the compression chambers 1*a*, 1*b*, or the exiting (compressed) gas, respectively, is illustrated by double arrows at the end side of the compression cylinders. The compression chambers 1*a*, 1*b* have in each case one gas inlet 5*a*, 6*a*, and one gas outlet 5*b*, 6*b*. The gas inlet 5*a*, 6*a* and the gas outlet 5*b*, 6*b*, can be formed by gas valves (not illustrated).

The volume of the compression chambers 1*a*, 1*b* by way of compression pistons 3*a*, 3*b* is periodically varied during the compression procedure.

The compression pistons 3*a*, 3*b*, movably delimit in each case the compression chambers 1*a*, 1*b* in a downward manner in the compression cylinder 2*a*, 2*b*. The compression pistons 3*a*, 3*b* in the embodiment illustrated when in operation perform work only in a stroke, that is to say that said compression pistons 3*a*, 3*b* are single-action compression pistons.

The compressor device 100 herein is aligned such that the force of gravity points downward. It is likewise conceivable and possible for the compressor device 100 to be aligned in an arbitrary manner in relation to the force of gravity. For example, the compressor device 100 can be aligned so as to be horizontal in relation to the force of gravity. The drive cylinders 12*a*, 12*b* are in each case disposed so as to be mutually coaxial below the at least one compression cylinder 2*a*, 2*b*. In other exemplary embodiments (not illustrated) the drive cylinders 12*a*, 12*b* are disposed above the at least one compression cylinder 12*a*, 12*b*.

Drive pistons 13*a*, 13*b* which in the embodiment illustrated are disposed in the two drive cylinders 12*a*, 12*b* serve for driving the compression pistons 3*a*, 3*b*.

The two drive pistons 13*a*, 13*b* subdivide in each case the internal chambers of the drive cylinders 12*a*, 12*b* into two drive chambers 11*a*, 11*b*, 11*c*, 11*d*. The volume of the drive chambers 11*a*, 11*b*, 11*c*, 11*d* can vary depending on the position of the drive pistons 13*a*, 13*b* within the drive cylinders 12*a*, 12*b*. The sum of the volumes of the drive chambers 11*a*, 11*b*, 11*c*, 11*d* in one drive cylinder 12*a*, 12*b* is in each case constant herein.

The first and the second drive chamber 11*a*, 11*b* are periodically impinged with a hydraulic fluid. The entering and exiting hydraulic fluid is illustrated by double arrows (hydraulic fluid infeed 18*a*, 18*b*). For example, when hydraulic fluid is forced into the first drive chamber 11*a* the drive piston 13*a* moves upward. The movement takes place along the movement axes Ba, Bb.

A third and a fourth drive chamber 11*c*, 11*d* is in each case indicated above the drive pistons 13*a*, 13*b*, said third and fourth drive chambers 11*c*, 11*d* being fluidically connected to one another by way of a connection piece (15).

For example, when the first drive piston 13*a* moves upward the fluid situated in the third drive chamber 11*c* is forced into the fourth drive chamber 11. An exchange of fluid between the drive chambers 11*c*, 11*d* takes place on account of the fluidic coupling (hydraulic non-positive locking coupling).

The drive pistons 13*a*, 13*b* are coupled to the compression pistons 3*a*, 3*b* by way of at least one mechanical connection means 20*a*, 20*b*, the latter here being a straight rod. In this embodiment, the drive cylinders 12*a*, 12*b* and the compression cylinders 2*a*, 2*b* lie in each case so as to be mutually aligned on top of one another.

On account of the mechanical connection means 20*a*, 20*b*, a movement of the drive pistons 13*a*, 13*b* is able to be transmitted to the compression pistons 3*a*, 3*b* which are movably disposed in the compression cylinders 2*a*, 2*b*. Movements of the drive pistons 13*a*, 13*b* are thus able to be converted to a volumetric variation of the compression chambers 1*a*, 1*b*.

The compression cylinders 2*a*, 2*b* in spatial terms herein are in each case disposed so as to be mutually separated from the two drive cylinders 12*a*, 12*b* by a spacing Da, Db. The risk of contaminations for example being carried from the drive cylinders 12*a*, 12*b* to the compression cylinders 13*a*, 13*b* is minimized by specifying said spacings Da, Db.

The spacings Da, Db also have the effect that the compression cylinders 13*a*, 13*b* do not share any common wall with the drive cylinders 12*a*, 12*b*; the compression cylinders 2*a*, 2*b* and the drive cylinders 12*a*, 12*b*, are mutually separated in particular in spatial, fluidic and also thermal terms.

In one embodiment, the spacing Da, Db can be chosen to be at least as long as the maximum distance travelled by one of the drive pistons 13*a*, 13*b* in the assigned drive cylinder 12*a*, 12*b*.

At least one connection chamber 30*a*, 30*b* which for purging the at least one connection chamber 30*a*, 30*b*, for detecting a leak in the at least one connection chamber 30*a*, 30 and/or for blocking the at least one connection chamber 30*a*, 30*b* is able to be filled with a functional gas is disposed between the compression cylinders 2*a*, 2*b*, and the drive cylinders 12*a*, 12*b* in the embodiment illustrated according to FIG. 1. The at least one connection chamber 30*a*, 30*b* is surrounded by a connection housing 40*a*, 40*b*.

The embodiment according to FIG. 1 furthermore has a cooling device 8*a*, 8*b* by way of which the compression cylinders 2*a*, 2*b* are able to be cooled in order for the waste heat created in the operation to be discharged. The cooling device in the embodiment illustrated is configured as a water-cooling system; the inflowing and outflowing water is illustrated by arrows. Water-cooling is expedient in particular in the case of compressors with a comparatively high output.

A measuring device 17 by way of which the position of one of the drive pistons 13*a*, 13*b* is to be determined is schematically illustrated in FIG. 1. The measuring device 17 is formed by a position sensor.

A stroke of 500 mm is able to be implemented using such a compressor device 100, for example. The overall height of the device in this instance would be approx. 1800 mm. In principle, other dimensions are also able to be implemented.

The embodiment according to FIG. 1 thus represents a single-action, single-stage, water-cooled compressor device 100 having a rod-proximal hydraulic coupling. The term rod-proximal here refers to the relative disposal in relation to the mechanical connection means 20*a*, 20*b* (rod).

Alternative construction modes for compression devices 100 will be illustrated in the figures hereunder, wherein reference is made to the description of the embodiment of FIG. 1 for the sake of brevity.

Figure 2:
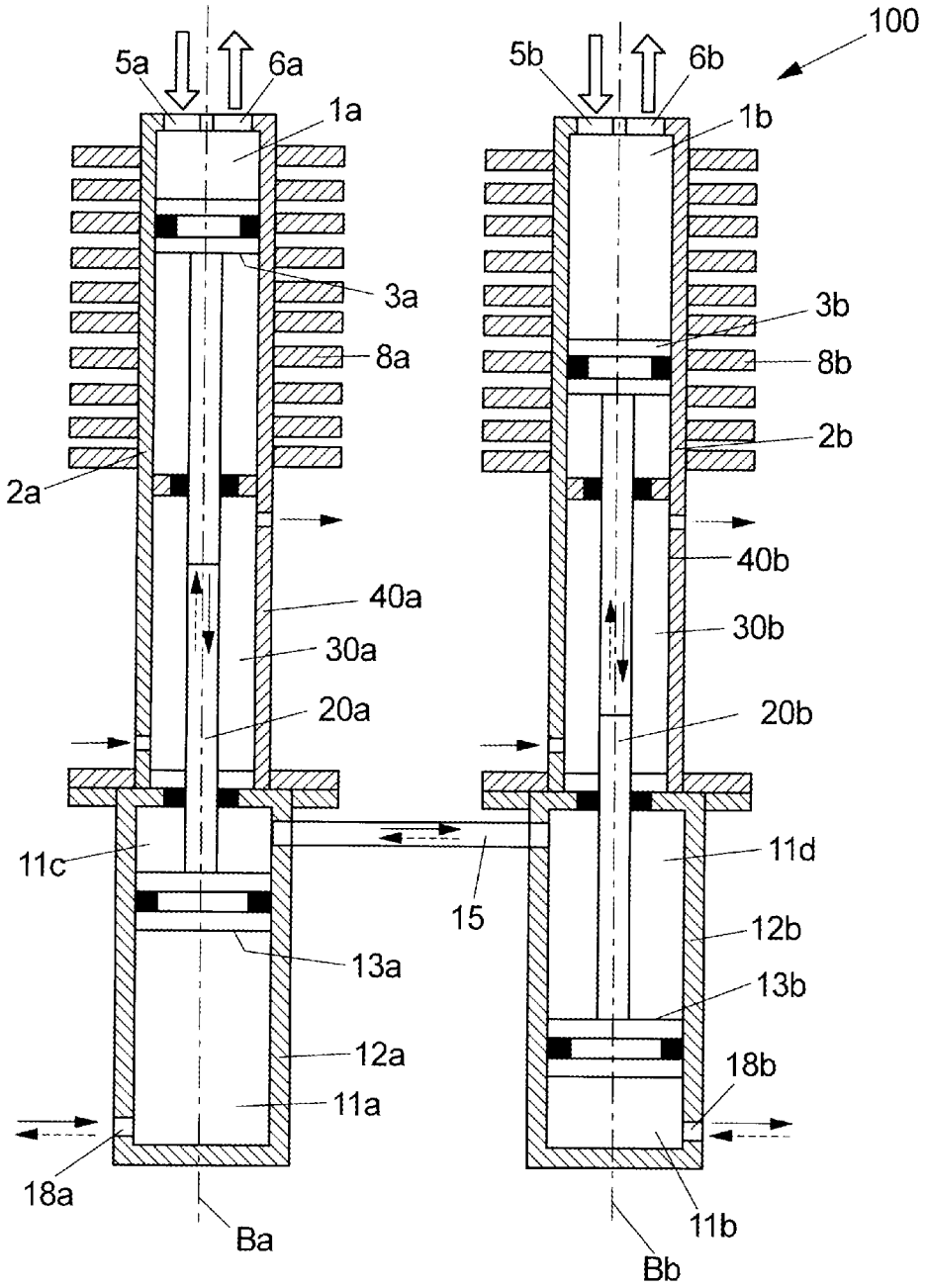
FIG. 2 shows a second embodiment of a compressor device (single-action, single-stage, air-cooled, rod-proximal hydraulic coupling of the drive chambers)

A second embodiment which is likewise single-action, single-stage and hydraulically coupled in a rod-proximal manner, but has an air-cooling system, is illustrated in FIG. 2.

Rib devices are disposed as a cooling device about the compression chambers 1*a*, 1*b* in this embodiment. The functional mode otherwise corresponds to that of the first embodiment.

Figure 3:
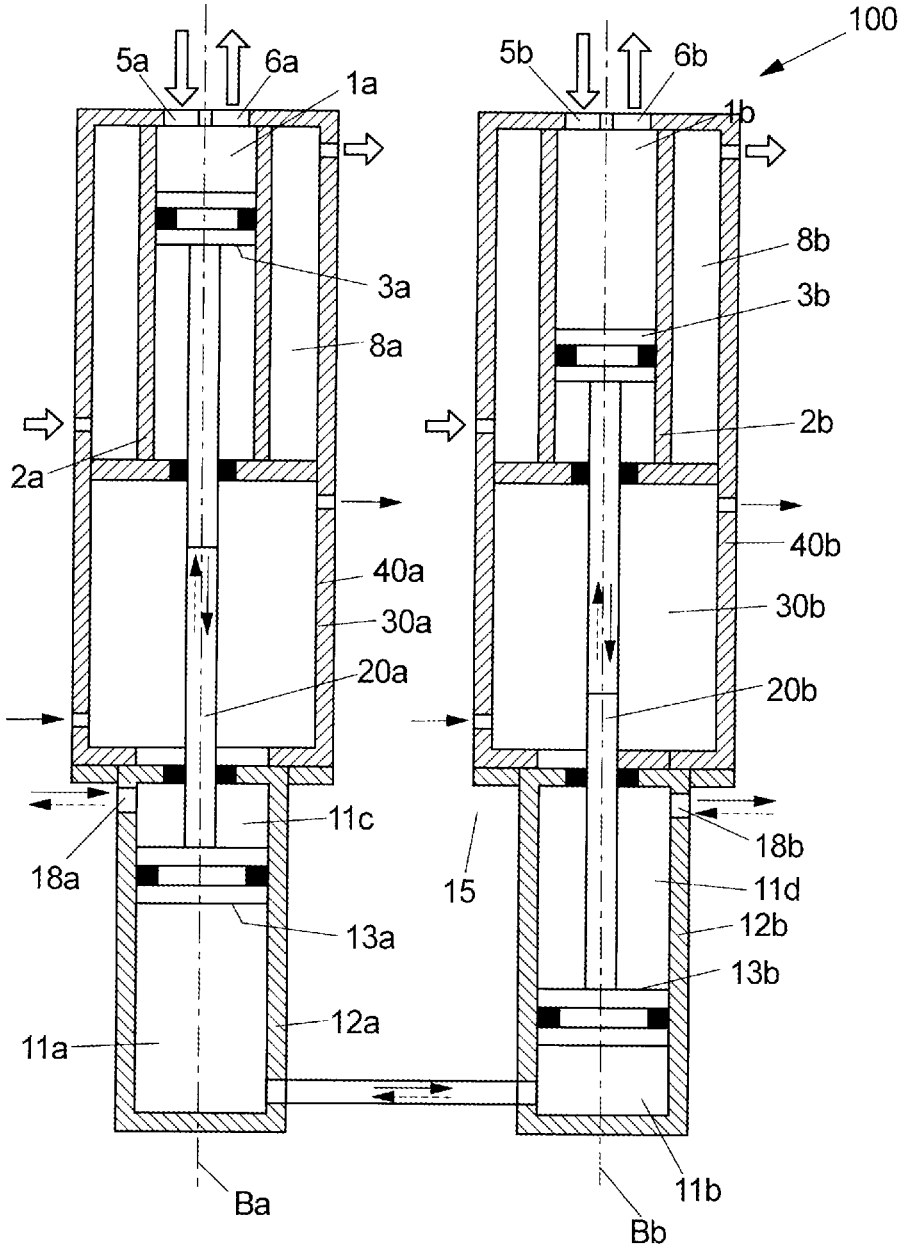
FIG. 3 shows a third embodiment of a compressor device (single-action, single-stage, water-cooled, piston-proximal hydraulic coupling of the drive chambers)

A third embodiment which represents a further variant of the embodiment of FIG. 1 is illustrated in FIG. 3.

Like the first embodiment, said third embodiment has a water-cooling system. However, the hydraulic coupling takes place not in a rod-proximal manner but in a piston-proximal manner by way of the connection piece 15. Accordingly, the hydraulic fluid infeed lines 18*a*, 18*b* lie above the drive pistons 13*a*, 13*b*, that is to say proximal to the rod.

Compressor devices of the type illustrated here can also be configured as dual-stage compressors.

Figure 4:
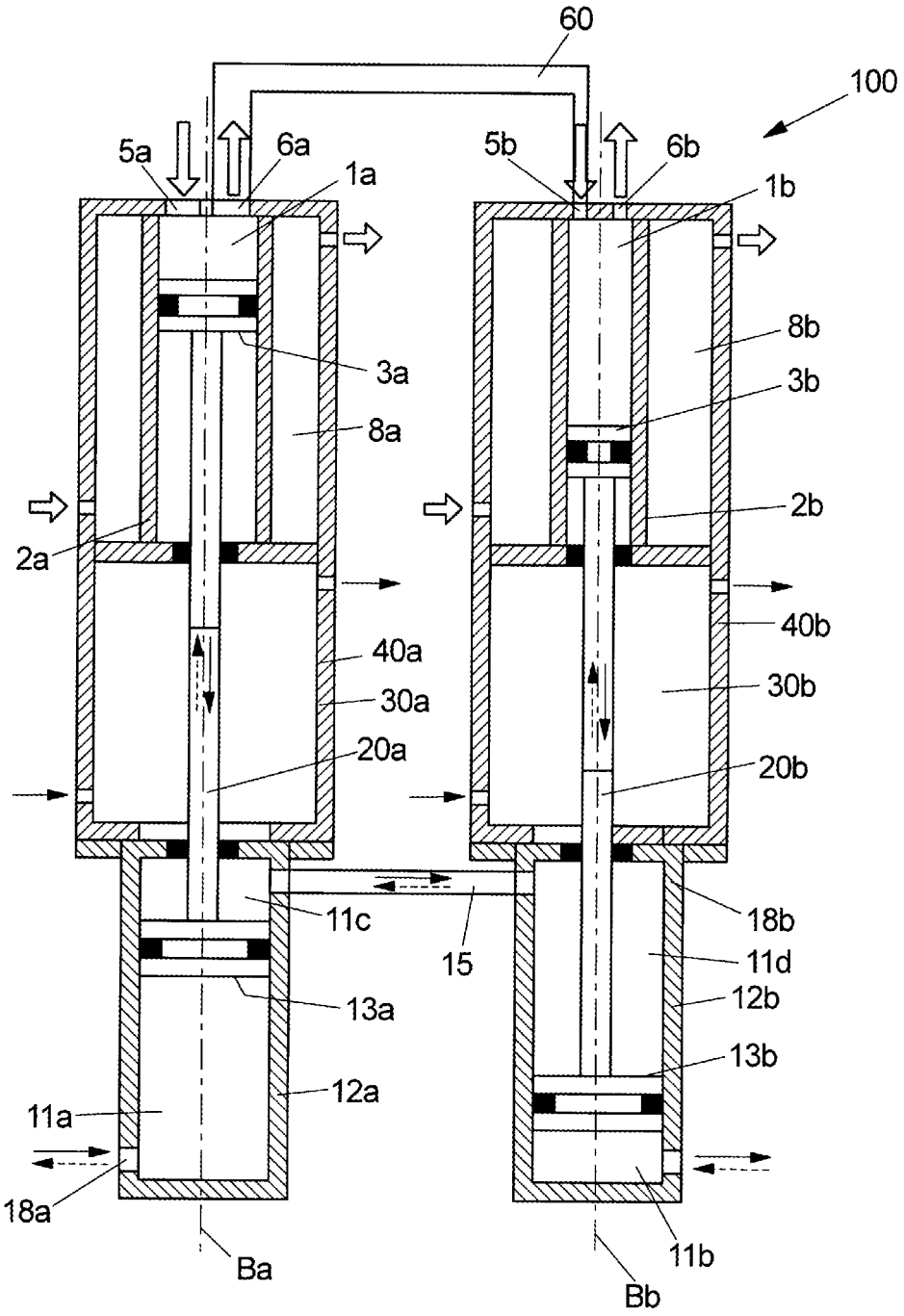
FIG. 4 shows a fourth embodiment of a compressor device (single-action, dual-stage, water-cooled, rod-proximal hydraulic coupling of the drive chambers)

FIG. 4 thus shows a single-action, dual-stage, water-cooled variant having a rod-proximal hydraulic coupling. The fourth embodiment otherwise corresponds to the first embodiment. As an additional feature, a connection line 60 between the first compression chamber 1*a* and the second compression chamber 1*b* by way of which compression in two stages is optionally able to be implemented is illustrated here.

Figure 5:
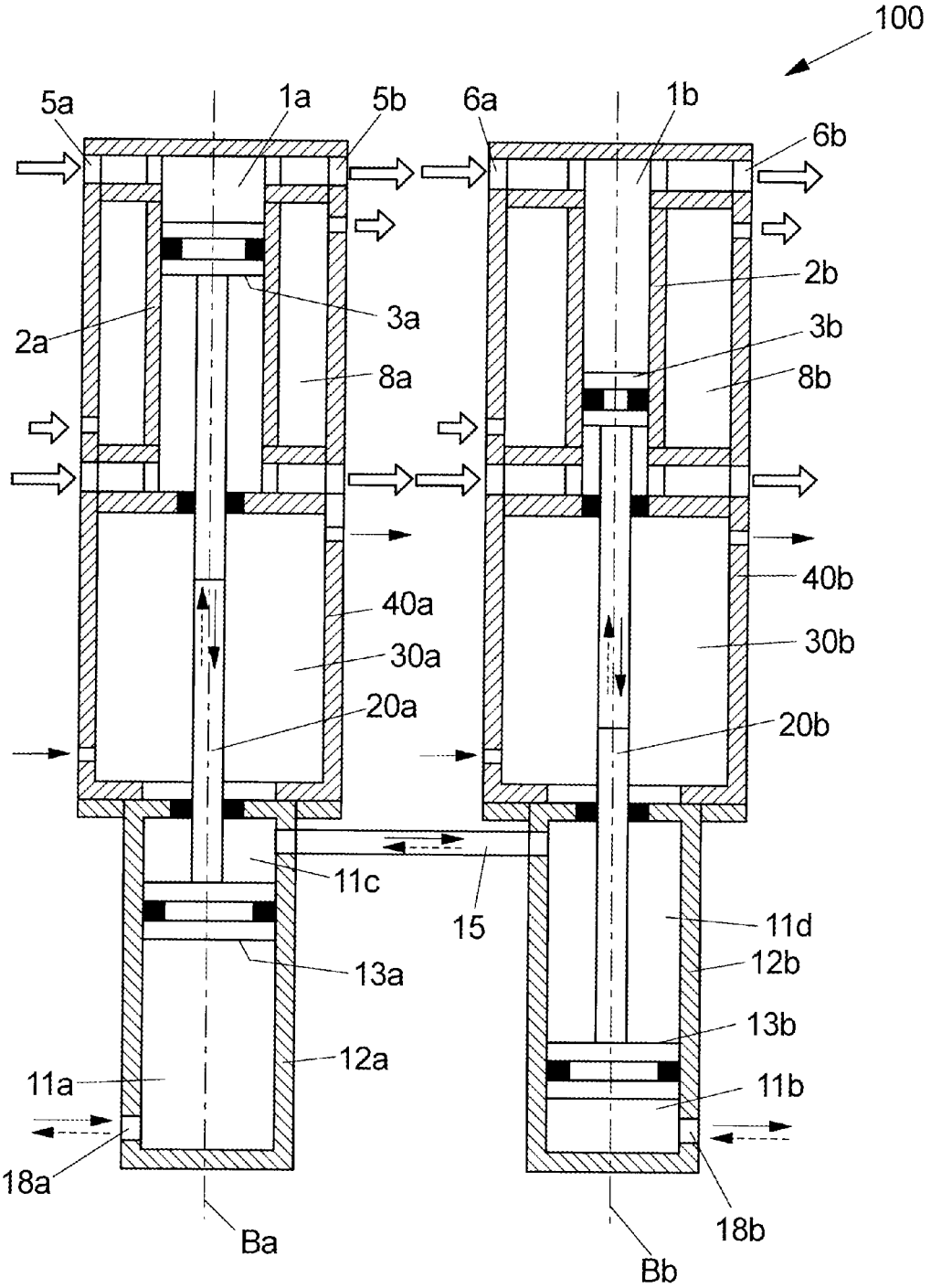
FIG. 5 shows a fifth embodiment of a compressor device (dual-action, four-stage water-cooled, rod-proximal hydraulic coupling of the drive chambers)

A further variant is illustrated in FIG. 5. As in the first embodiment, a water-cooled compression device 100 is present, in which a rod-proximal hydraulic coupling of the drive chambers 11*c*, 11*d* is present.

However, the compression chamber 1*a*, 1*b* in this embodiment is configured such that the compressor device 100 operates in a dual-action manner, that is to say that each stroke of the compression piston 3*a*, 3*b* performs work. Accordingly, the compression chambers 1*a*, 1*b*, 1*c*, 1*d*, 1*e*, 1*f* have in each case one inlet and one outlet.

Figure 6A:
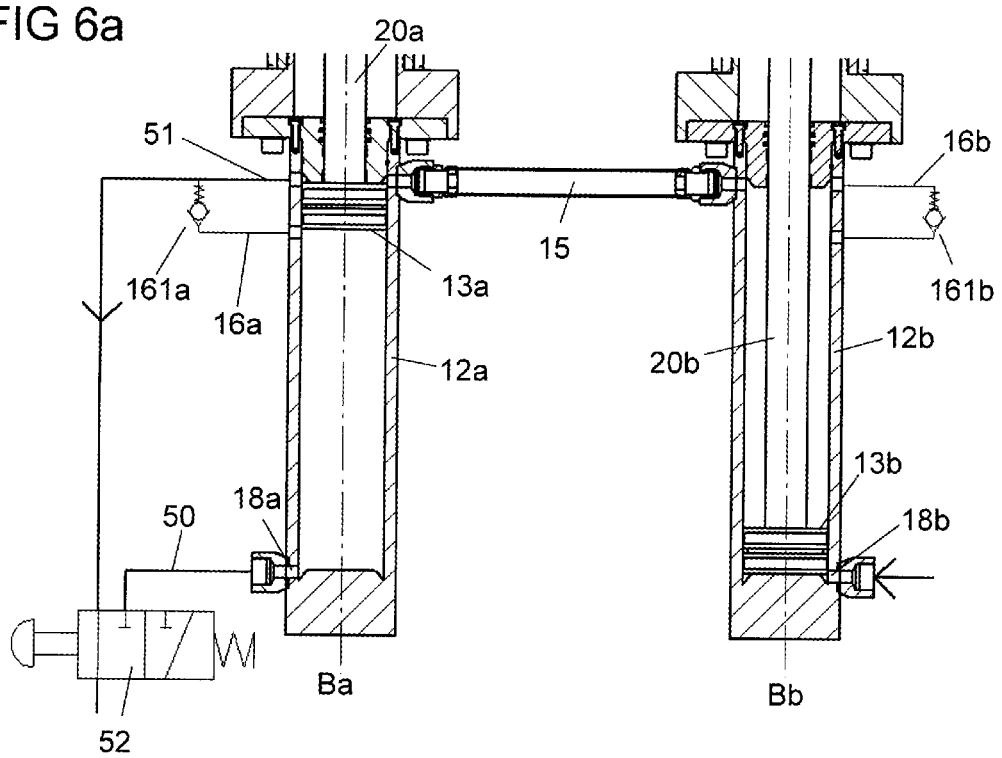
FIG. 6*a* shows an embodiment of a compression device having a valve control system in a first position.
Figure 6B:
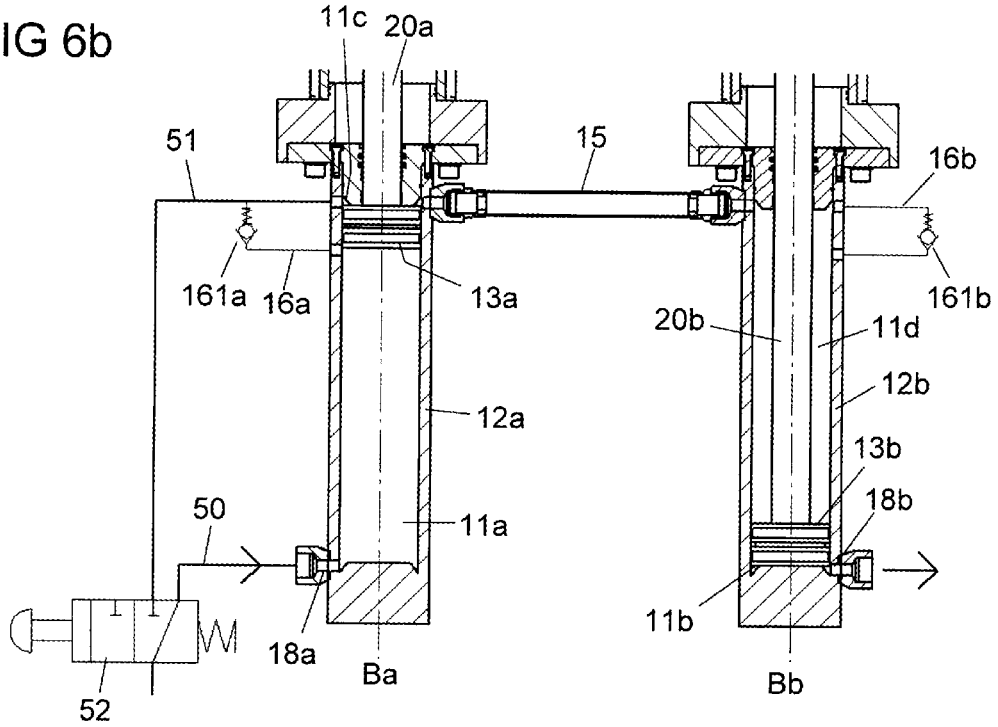
FIG. 6*b* shows the embodiment according to FIG. 6*a* in a second position.

A further advantage of the compressor device 100 is derived from the hydraulically coupled drive cylinders 12*a*, 12*b*. On account of the fact that the two compression pistons 3*a*, 3*b* are in each case driven by a dedicated drive cylinder 12*a*, 12*b*, the stroke of a first cylinder can be varied independently of the second drive cylinder during the operation by way of the construction of a suitable hydraulic circuit. An embodiment to this end is illustrated in FIGS. 6*a*, 6*b*.

This decoupling is above all highly advantageous when compressing gases to a constant output pressure at a sinking input pressure (for example when emptying bottles). In a dual-stage plant the intermediate pressure likewise sinks on account of the sinking input pressure since the two stages are designed with a view to only one specific type of application (tight range). A deviation from this design point is tolerated only to a minor extent, for example by way of an indicated pressure range at the gas input. Any excessive deviation leads to non-uniform and unfavorable compression ratios in one of the two stages, depending on whether the permissible range has been exceeded or undershot. This results in an excessive and unforeseen generation of heat which can cause damage to components. This principle in analogous manner also applies to filling containers, in which the output pressure varies and in particular increases.

On account of the possibility of operating a variable stroke in one of the two drive cylinders 12*a*, 12*b*, the two stages can be adapted to variable operating conditions during the operation. Any unnecessary generation of heat on account of highly dissimilar compression ratios in the two stages is avoided on account thereof, and the input pressure can be operated in an optimal manner in a larger range (above all in low pressure ranges).

This adjustment of stroke is achieved by a variation in the hydraulic management in the drive cylinders 12*a*, 12*b*.

The hydraulic output 50 of the first drive cylinder 12*a* is blocked when the desired stroke is reached while the first drive piston 13*a* moves downward, while the hydraulic fluid (oil) of the upward moving second drive piston 13*b* is simultaneously discharged by way of an additional hydraulic fluid output 51.

In this way, one of the drive pistons is stationary during the stroke; the drive piston coupled thereto can fully complete the stroke on account of the oil being diverted. The strokes of the two drive pistons 13*a*, 13*b* can thus be mutually decoupled by way of a suitable valve device 52.

A pressure compensation line 16*a*, 16*b* is disposed at an end of the third and the fourth drive chamber 11*c*, 11*d*, where a reversal of the movement of the respective drive piston 13*a*, 13*b* takes place. The pressure compensation line 16*a*, 16*b*, in a position of the drive piston 13*a*, 13*b* at which the reversal of the movement takes place, bypasses the drive piston 13*a*, 13*b* such that the two drive chambers 11*a*, 11*b*, 11*c*, 11*d* of a drive cylinder 12*a*, 12*b* are able to be connected by way of the pressure compensation line 16*a*, 16*b*. The pressure compensation line 16*a*, 16*b* has a check valve 161*a*, 161*b* for controlling the connection between the drive chambers 11*a*, 11*b*, 11*c*, 11*d*.

Figure 7:
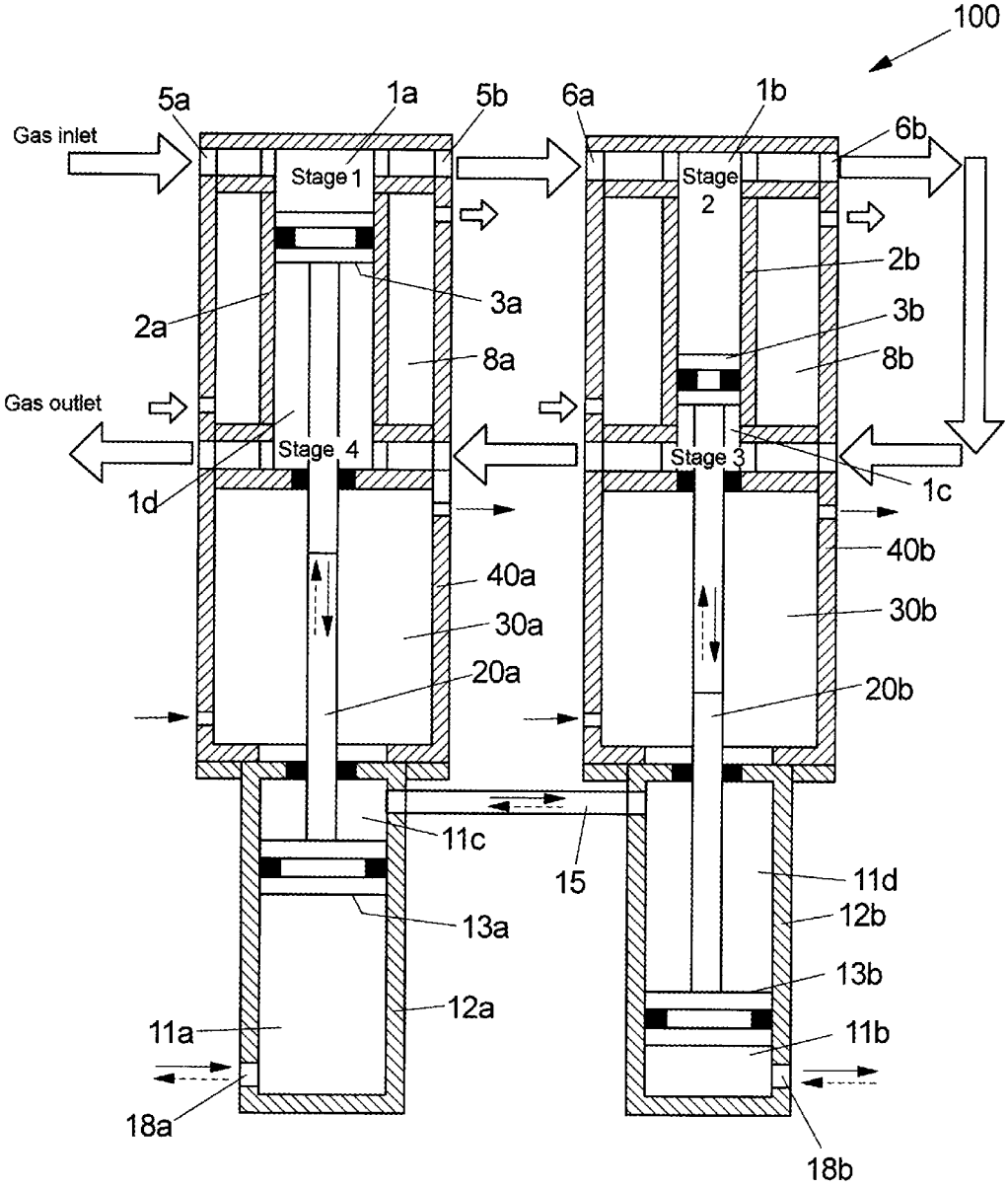
FIG. 7 shows a schematic illustration of a further embodiment of a compression device having four-stage compression.

A modification of the embodiment according to FIG. 5 is illustrated in FIG. 7, so that reference can be made to the description above.

Implemented here is a four-stage compression in which the first compression chamber 1*a* forms the first stage. The compressed gas is supplied to a second stage in the compression chamber 1*b* by way of the gas outlet 5*b* and the gas inlet 6*a*. The gas is then supplied to a third stage by way of the gas outlet 6*b* of this compression chamber 1*b*, said third stage being implemented in a third compensation chamber 1*c*. The gas is subsequently supplied back to the first compression cylinder in which a fourth compression stage is implemented in the compression chamber 1*d*. The flow of gas between the two compression cylinders is illustrated by arrows in FIG. 7. The size of the compression chambers 1*a*, 1*b*, 1*c*, 1*d* here is optionally to be adapted to the compression task.

Figure 8A:
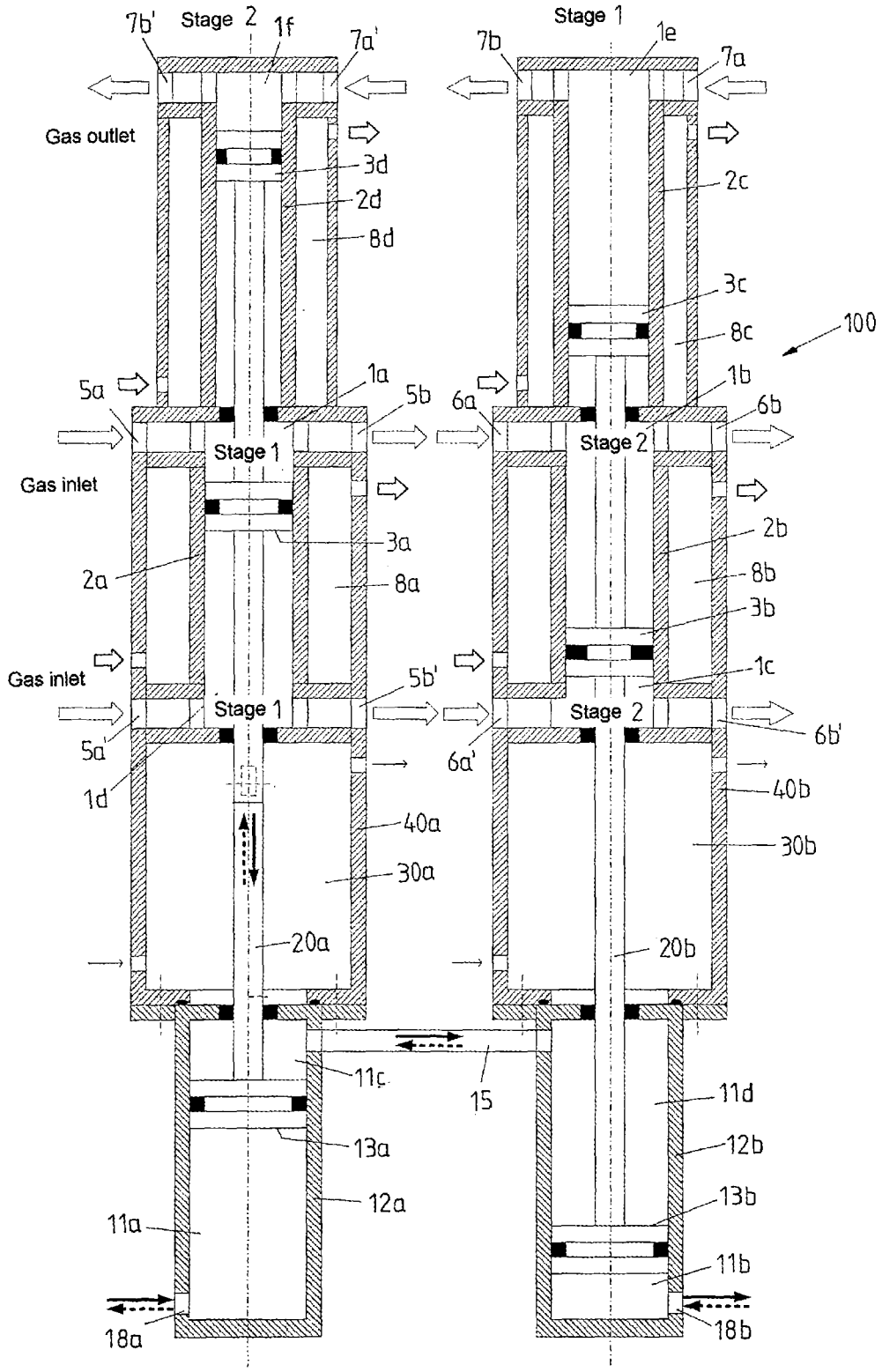
FIG. 8A shows a schematic illustration of an alternative embodiment of a compression device having three dual-stage compressions.
Figure 8B:
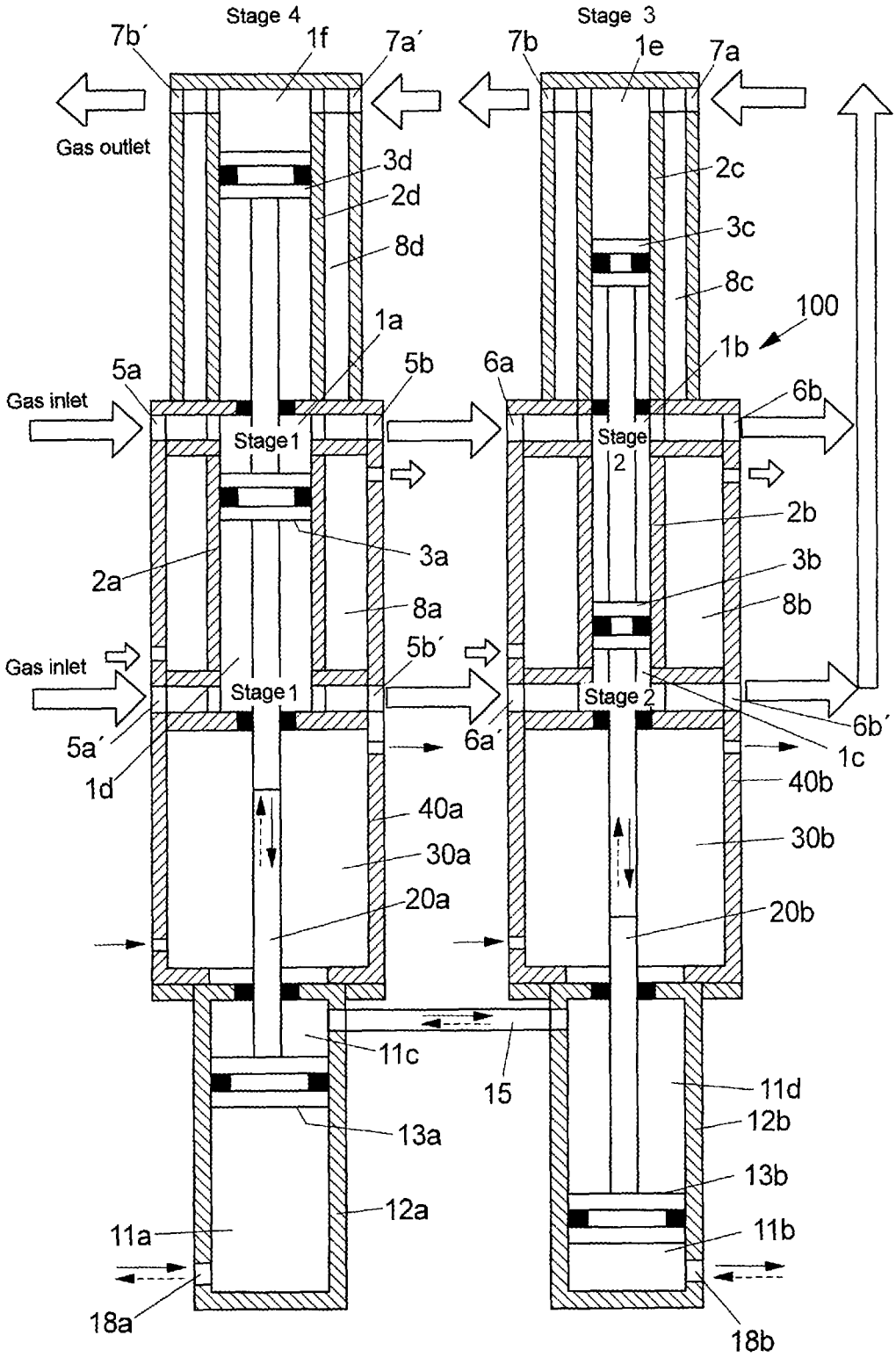
FIG. 8B shows a schematic illustration of an alternative embodiment of a compression device having four-stage compression.

In an alternative embodiment according to FIG. 8A and FIG. 8B, compression in at least two stages is implemented in which the first compression chamber 1*a* and the fourth compression chamber 1*d* form the first stage. The gas to be compressed is in each case supplied to the first compression chamber 1*a* and to the fourth compression chamber 1*d* by one gas inlet 5*a*,5*a*'. The gas to be compressed herein is in particular supplied in an alternating manner to the first compression chamber 1*a* and to the fourth compression chamber 1*d*. The compressed gas, as gas to be further compressed, is in each case supplied to a second stage in the compression chambers 1*b*, 1*c* by way of one gas outlet 5*b*, 5*b*'. The gas to be further compressed is in each case supplied to the second compression chamber 1*b* and to the third compression chamber 1*c* by way of one gas inlet 6*a*, 6*a*'. The gas from the first compression chamber 1*a* herein is supplied to the second compression chamber 1*b*, and the gas from the fourth compression chamber 1*d* is supplied to the third compression chamber 1*c*. The gas to be further compressed is guided onward from the second compression chamber 1*b* and from the third compression chamber 1*c* by way of a gas outlet 6*b*, 6*b*'.

According to FIG. 8A, the gas further compressed in the second stage is guided onward for further processing.

According to FIG. 8B, the further compressed gas from the second compression chamber 1*b* and from the third compression chamber 1*c* is supplied to further compression stages.

The compressor devices of FIG. 8A and FIG. 8B comprise four compression cylinders 2*a*, 2*b*, 2*c*, 2*d*. The compressor devices thus correspond substantially to the exemplary embodiment of FIG. 7, wherein the two compression cylinders 2*c*, 2*d* are upgraded. One cooling device 8*c*, 8*d* by way of which the compression cylinders 2*c*, 2*d* are able to be cooled is in each case disposed on the compression cylinders 2*c*, 2*d*. The movement of the drive pistons 13*a*, 13*b* by way of a mechanical connection means 20*a*, 20*b* is in each case able to be transmitted to four compression pistons 3*a*, 3*b*, 3*c*, 3*d* which are in each case disposed so as to be movable in a compression cylinder 2*a*, 2*b*, 2*c*, 2*d*. Two compression pistons 3*a*, 3*b*, 3*c*, 3*d* are disposed on each of the mechanical connection means 20*a*, 20*b*. In principle, the compression pistons 3*a*, 3*b*, 3*c*, 3*d* can in each case divide the compression cylinders 2*a*, 2*b*, 2*c*, 2*d* into two compression chambers in which gas can in each case be compressed in a mutually independent manner or in multiple stages. A sequence in which the gas is guided through the compression chambers of the compression device can be chosen in an arbitrary manner. Likewise, a number of stages of compression and/or a number of simultaneously operated, optionally multi-stage, compressions can be chosen in an arbitrary manner.

In FIG. 8A, gas is compressed in the first compression chamber 1*a* and is then supplied to the second compression chamber 1*b*. Independently thereof, gas is compressed in a fifth compression chamber 1*e* of the third compression cylinder 2*c*. The gas to be compressed is supplied to the fifth compression chamber 1*e* by way of a gas inlet 7*a*. The compressed gas as gas to be further compressed is supplied to a further stage in a sixth compression chamber 1*f* by way of a gas outlet 7*b*. The gas to be further compressed is supplied to the sixth compression chamber 1*f* by way of a gas inlet 7*a*'. The further compressed gas from the sixth compression chamber 1*f* is guided onward by way of a gas outlet 7*b*'.

Alternatively, the gas can likewise be compressed in more than two stages. A four-stage compressor device is illustrated in FIG. 8B. In contrast to the compressor device illustrated in FIG. 8A, gas is supplied to the gas inlet 7*a* of the fifth compression chamber 1*e* in that a third compression stage is implemented. The gas is then supplied to a fourth stage which is implemented in a sixth compression chamber 1*f* by way of a gas outlet 7*b* of the compression chamber 1*e*. The gas is supplied to the sixth compression chamber 1*f* by way of a gas inlet 7*a*'. The gas compressed in the sixth compression chamber 1*f* is guided onward for further processing by way of a gas outlet 7*b*'. The diameters of the drive pistons 3*a*, 3*d* are larger than the diameters of the drive pistons 3*b*, 3*c*. In principle, the size of the drive pistons 3*a*, 3*b*, 3*c*, 3*d*, like the size of the compression chambers 1*a*, 1*b*, 1*c*, 1*d*, is optionally to be adapted to the compression task.

Figure 8C:
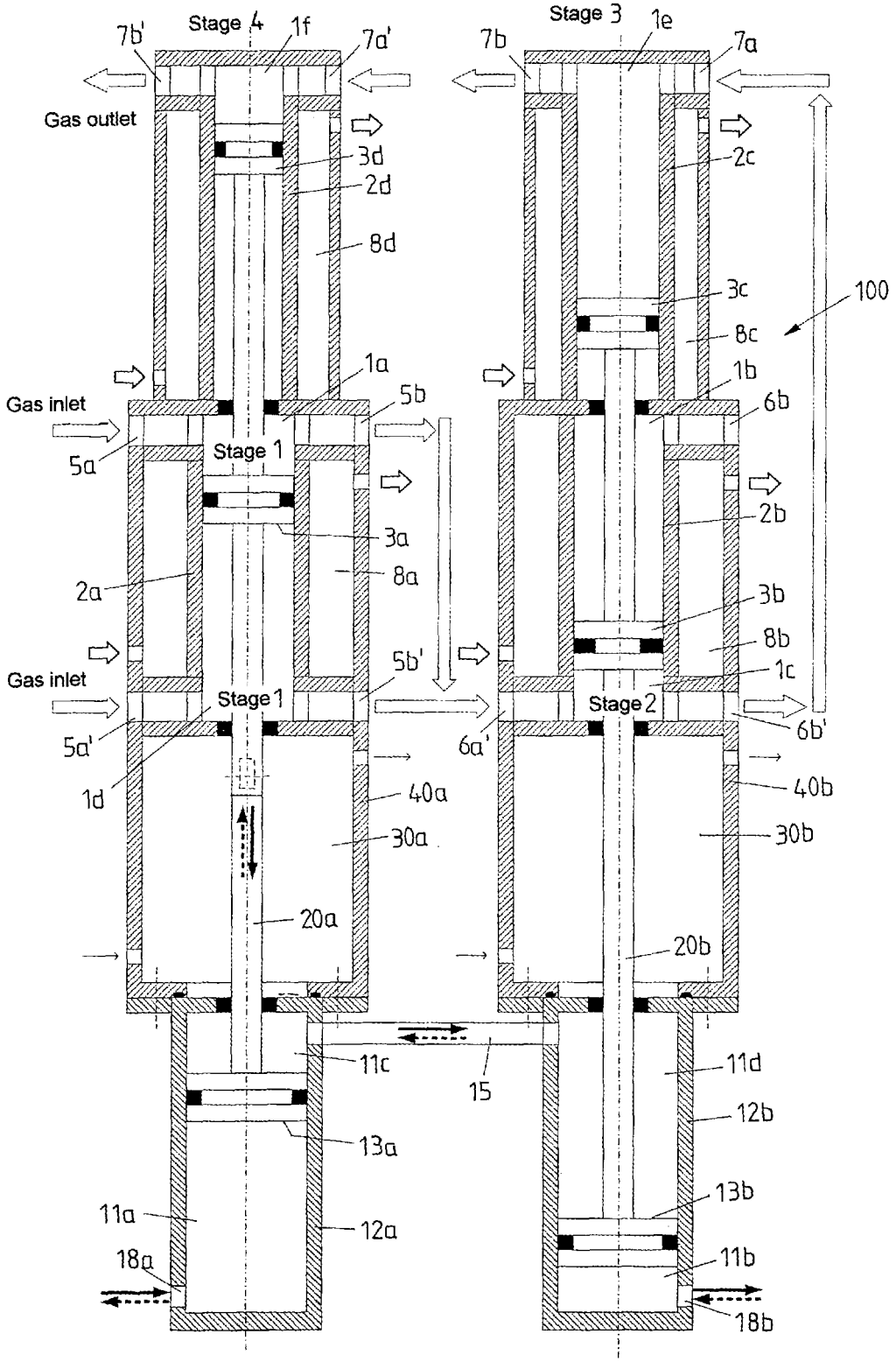
FIG. 8C shows a schematic illustration of an alternative embodiment of a compression device having four-stage compression and having alternative guiding of the gas to be compressed.

Alternative guiding of the gas through the compressor device is illustrated in FIG. 8C. The compressed gas herein as gas to be further compressed is supplied to a second stage in the compression chamber 1*c* by way of the gas outlets 5*b*, 5*b*'. The gas to be further compressed is in each case supplied to the second compression chamber 1*b* and to the third compression chamber 1*c* by way of a gas inlet 6*a*, 6*a*'. The further compressed gas from the third compression chamber 1*c* is supplied to the fifth compression chamber 1*e*. Thereafter, the gas is supplied to the fourth stage of the sixth compression chamber 1*f*.

Figure 8D:
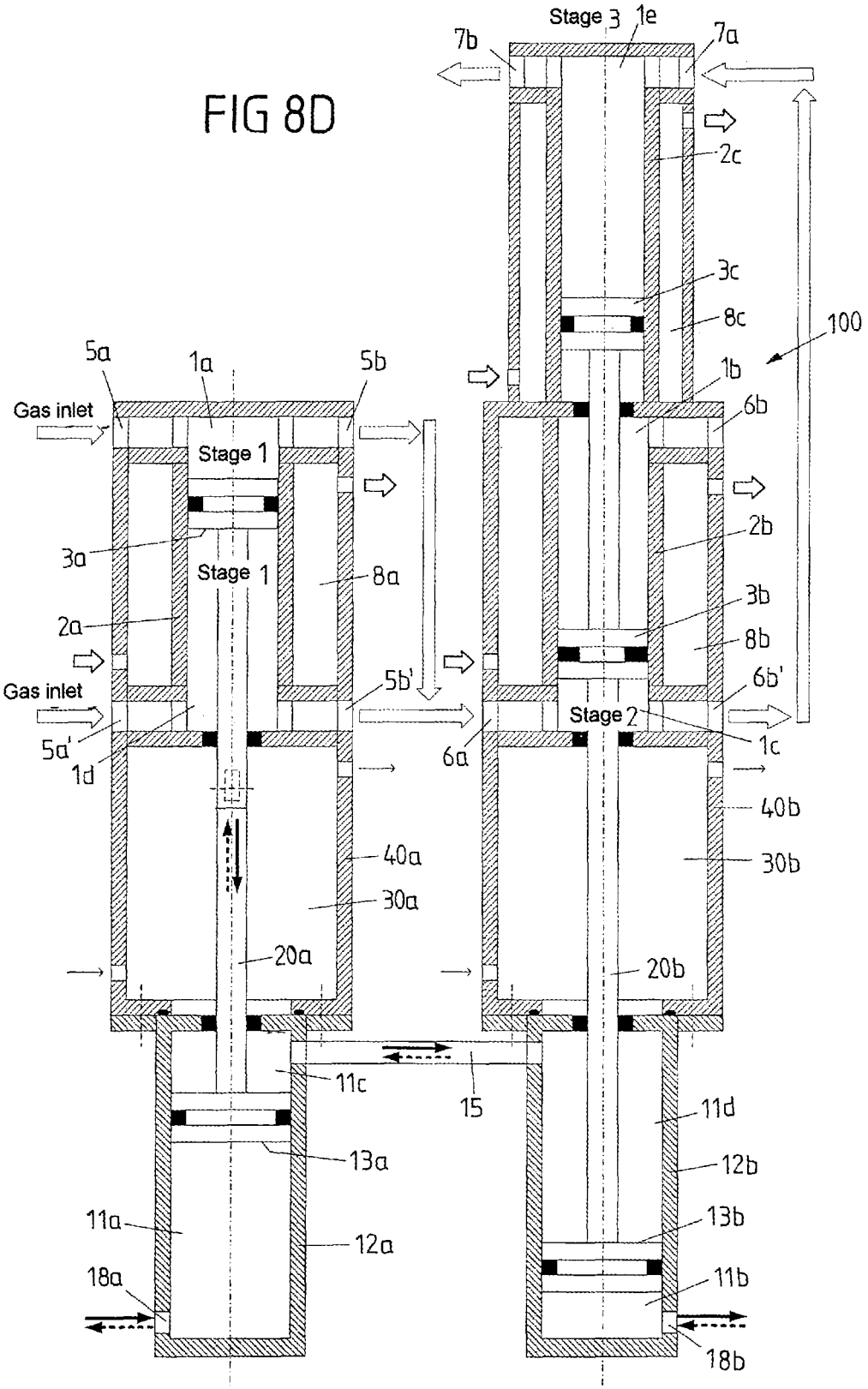
FIG. 8D shows a schematic illustration of an alternative embodiment of a compression device having three-stage compression.

Alternatively, the gas, proceeding from the third stage, can be provided for further processing by the fifth compression chamber 1*e*, as is illustrated in FIG. 8D. The movement of the drive piston 13*a* by way of the mechanical connection means 20*a* herein is able to be transmitted to a compression piston 3*a*, wherein the movement of the drive piston 13*b* by way of the mechanical connection means 20*b* is able to be transferred to two compression pistons 3*b*, 3*c*. In principle, any arbitrary number of compression pistons connected to the mechanical connection means 20*a*, 20*b*, and any arbitrary guiding of the gas to be compressed, the compressed gas, and the gas to be further compressed in the compression chambers is conceivable and possible. The size of the compression chambers 1*a*, 1*b*, 1*c*, 1*d*, 1*e*, 1*f* herein is optionally to be adapted to the compression task.

The above embodiments are merely preferred embodiments of the present disclosure. It should be set forth that, for a person skilled in the art, improvements and modifications may be made, with such improvements and modifications being deemed to be within the protection and scope of the present disclosure without departing away from the principles of the present disclosure.

LIST OF REFERENCE SIGNS

1*a*, 1*b*, 1*c*, 1*d*, 1*e*, 1*f* Compression chamber
2*a*, 2*b*, 2*c*, 2*d* Compression cylinder
3*a*, 3*b*, 3*c*, 3*d* Compression piston
5*a*, 6*a*, 5*a*', 6*a*', 7*a*, 7*a*' Gas inlet
5*b*, 6*b*, 5*b*', 6*b*', 7*b*, 7*b*' Gas outlet
8*a*, 8*b*, 8*c*, 8*d* Cooling device
11*a*, 11*b*, 11*c*, 11*d* Drive chamber
12*a*, 12*b* Drive cylinder
13*a*, 13*b* Drive piston
15 Connection piece
16*a*, 16*b* Pressure compensation line
161*a*, 161*b* Check valve
17 Measuring device
18*a*, 18*b* Hydraulic fluid infeed lines
20*a*, 20*b* Mechanical connection means
30*a*, 30*b* Connection chamber
40*a*, 40*b* Connection housing
50 Hydraulic output
51 Additional hydraulic fluid output
52 Valve device
100 Compressor device
Ba, Bb Movement axis
Da, Db Spacing

The invention claimed is:

1. A compressor device for compressing hydrogen gas in at least two compression chambers in at least two compression cylinders, wherein a) in each of at least two drive cylinders at least one drive piston is disposed, said at least one drive piston dividing each of the at least two drive cylinders into two drive chambers;

b) at least one first drive chamber in a first drive cylinder of the at least two drive cylinders and at least one second drive chamber in a second drive cylinder of the at least two drive cylinders, by way of a hydraulic fluid, are configured to be periodically impinged with a fluid pressure in order for the respective drive piston to be moved;

c) at least one third drive chamber in the first drive cylinder and at least one fourth drive chamber in the second drive cylinder are connected in a non-positive locking manner by a fluid directly by way of a connection piece;

d) the movement of each of the at least one drive piston, by way of one assigned mechanical connection means of at least two mechanical connection means, is able to be transmitted to one assigned compression piston of at least two compression pistons which are disposed so as to be movable in the at least two compression cylinders, the at least two compression cylinders holding hydrogen, said compression pistons movably delimiting the at least two compression chambers in the at least two compression cylinders on one side such that movements of each of the at least two drive pistons are able to be converted to a volumetric variation of the respective at least one compression chamber;

e) the at least two compression cylinders are disposed so as to be higher along a direction of gravity than the at least two drive cylinders and separated from the at least two drive cylinders by a spacing, wherein the spacing has at least the size of a maximum distance travelled by one of the at least one drive pistons in the assigned drive cylinder and at least the size of 5/18 of a height of the compressor device; and f) at least two connection chambers are filled with a functional gas and a first connection chamber of the at least two connection chambers is disposed between a first compression cylinder of the at least two compression cylinders and the first drive cylinder, and a second connection chamber of the at least two connection chambers is disposed between a second compression cylinder of the at least two compression cylinders and the second drive cylinder.

2. The compressor device as claimed in claim 1, wherein the at least two compression cylinders do not share any common wall with the at least two drive cylinders.

3. The compressor device as claimed in claim 1, wherein the at least two connection chambers are configured to be filled with the functional gas for purging the at least two connection chambers, for detecting leaks in the at least two connection chambers, and/or for blocking the at least two connection chambers.

4. The compressor device as claimed in claim 1, wherein at least one measuring device is provided, and wherein the at least one measuring device is configured to determine a position of at least one drive piston of the at least two drive pistons, at least one mechanical connection means of the at least two mechanical connection means, and/or at least one compression piston of the at least two compression pistons.

5. The compressor device as claimed in claim 1, wherein the at least two mechanical connection means are straight rods.

6. The compressor device as claimed in claim 1, wherein a seal is provided between at least one compression cylinder of the at least two compression cylinders and at least one compression piston of the at least two compression pistons and/or a seal is provided between at least one compression cylinder of the at least two compression cylinders and at least one mechanical connection means of the at least two mechanical connection means.

7. The compressor device as claimed in claim 1, wherein a cooling device, which discharges waste heat created in the operation of the at least one compression cylinder, is disposed on the at least one compression cylinder.

8. The compressor device as claimed in claim 1, wherein a compressed gas for forming a compression in multiple stages is configured to be directed as gas to be further compressed from a first compression chamber into at least one second compression chamber.

9. The compressor device as claimed in claim 1, further comprising a valve device for decoupling the movement of the drive pistons.

10. The compressor device as claimed in claim 1, further comprising a control system for controlling the impingement of the at least one first and second drive chamber with the hydraulic fluid via the valve device.

11. The compressor device as claimed in claim 1, wherein the fluid pressure between the at least one first and second drive chamber and each of the remaining drive chambers is configured to be synchronized via at least one synchronizing installation which bypasses the respective drive piston.

12. The compressor device as claimed in claim 2, wherein the at least one connection chamber is configured to be filled with the functional gas for purging the at least one connection chamber, for detecting leaks in the at least one connection chamber, and/or for blocking the at least one connection chamber.

13. The compressor device as claimed in claim 2, wherein at least one measuring device is provided, and wherein the at least one measuring device is configured to determine a position of the at least one drive piston, the at least one mechanical connection means, and/or the at least one compression piston.

14. The compressor device as claimed in claim 2, wherein the at least two drive cylinders are disposed below the at least one compression cylinder.

15. The compressor device as claimed in claim 1, wherein the at least one third drive chamber and the at least one fourth drive chamber are upper chambers, and the at least one first drive chamber and the at least one second drive chamber are lower chambers, and wherein the upper chambers are fluidly connected via the connection piece and the lower chambers are not fluidly connected.

16. The compressor device as claimed in claim 1, wherein the at least two drive cylinders are narrower than the at least two connection chambers.

* * * * *